US006206218B1

(12) United States Patent
Young et al.

(10) Patent No.: US 6,206,218 B1
(45) Date of Patent: Mar. 27, 2001

(54) NESTED CONTAINERS

(75) Inventors: William C. Young, Ypsilanti, MI (US); Richard C. Darr, Medina, OH (US); William A. Slat, Brooklyn, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

(21) Appl. No.: 09/535,829

(22) Filed: Mar. 28, 2000

(51) Int. Cl.[7] ..... B65D 21/02
(52) U.S. Cl. ..... 220/23.4; 220/23.86; 220/756
(58) Field of Search ..... 220/23.4, 23.83, 220/23.86, 737, 756

(56) References Cited

U.S. PATENT DOCUMENTS

| | | | | |
|---|---|---|---|---|
| 4,003,491 | | 1/1977 | Wells et al. . | |
| 4,165,812 | | 8/1979 | Jennison . | |
| 4,196,808 | * | 4/1980 | Pardo | 206/432 |
| 4,235,343 | | 11/1980 | Thompson . | |
| 4,381,841 | | 5/1983 | Schwarz . | |
| 4,592,478 | | 6/1986 | Laconis . | |
| 4,685,565 | | 8/1987 | Sparling . | |
| 4,708,253 | | 11/1987 | Mednis . | |
| 4,925,066 | * | 5/1990 | Rosenbaum | 220/23.4 |
| 4,950,083 | * | 8/1990 | Bavaveas | 220/23.4 |
| 5,065,875 | * | 11/1991 | Balavich | 220/23.4 |
| 5,123,460 | * | 6/1992 | Reed | 220/23.4 |
| 5,135,116 | | 8/1992 | Pamzetti . | |
| 5,316,159 | | 5/1994 | Douglas et al. . | |
| 5,669,519 | | 9/1997 | Notz et al. . | |
| 5,671,503 | * | 9/1997 | Uebelacker et al. | 220/756 |
| 5,996,825 | | 12/1999 | Gordon et al. . | |

* cited by examiner

*Primary Examiner*—Joseph M. Moy
(74) *Attorney, Agent, or Firm*—Bachman & LaPointe, P.C.

(57) ABSTRACT

The present invention relates to nested containers including a first container having a handle extending outwardly from the side wall thereof and at least one recess formed by the handle and adjacent side wall of the first container. At least one second container dimensioned to be inserted in the recess is inserted in the recess and first and second containers secured tightly together.

13 Claims, 4 Drawing Sheets

NESTED CONTAINERS

BACKGROUND OF THE INVENTION

The present invention relates to containers for holding contents, as fluids or powders or the like, particularly plastic containers, and specifically nested containers with means provided for securing at least two containers together.

Various designs are known for securing multiple containers together. For example, container packages are known where one container includes a recess shaped to accommodate the elongated neck of an adjacent container. Another package involves forming containers in a stack either side-by-side or one on top of another, following by wrapping an external securing means.

However, such known devices are either not entirely effective, inconvenient or awkward, or the external securing means can become disengaged as during shipment resulting in separation of the containers.

It is particularly desirable to provide a nested container package or assembly which includes a larger container for refilling one or more smaller containers. It is particularly desirable to provide such a nested container assembly which does not interfere with the handling of the assembly and which provides convenient and easy handling and shipment of the nested container package or assembly.

It is, therefore, a principal objective of the present invention to provide a nested container package or assembly which simply, conveniently and effectively obtains the foregoing objectives.

It is a further objective of the present invention to provide a package or assembly as aforesaid which is convenient and inexpensive to produce and assemble.

Further objects and advantages of the present invention will appear hereinbelow.

SUMMARY OF THE INVENTION

In accordance with the present invention, the foregoing objects and advantages are readily obtained.

The nested container package or assembly of the present invention comprises: a first container for holding contents, as a fluid or powder or the like, said first container having a bottom wall, top wall and side wall, and a handle integrally formed thereon and extending outwardly from the side wall of the first container; at least one recess formed by the handle and adjacent side wall of the first container; at least one second container, generally smaller than the first container, for holding contents dimensioned to be inserted in the recess, with the second container having a side wall; a groove in one of the side wall of the second container and said recess, and a projection extending outwardly from the other of the side wall of the second container and said recess; whereby, the first and second containers are secured tightly together by inserting the second container in the recess and the projection in the groove.

The groove is preferably on the side wall of the second container, although it could naturally be on the side wall of the first container in the location of the recess. Generally, two of said second containers are provided, one on either side of the handle in recesses on either side of the handle. Also, the outwardly extending handle of the first container preferably overlaps the second container, or both of the second containers. Also, if desired a circumferential wrapping can be provided surrounding the assembly of containers.

Further features and advantages of the present invention will appear hereinbelow.

BRIEF DESCRIPTION OF THE DRAWINGS

The present invention will be more readily apparent from the accompanying drawings which show representative embodiments, wherein.

DETAILED DESCRIPTION OF PREFERRED EMBODIMENTS

Figure 2:
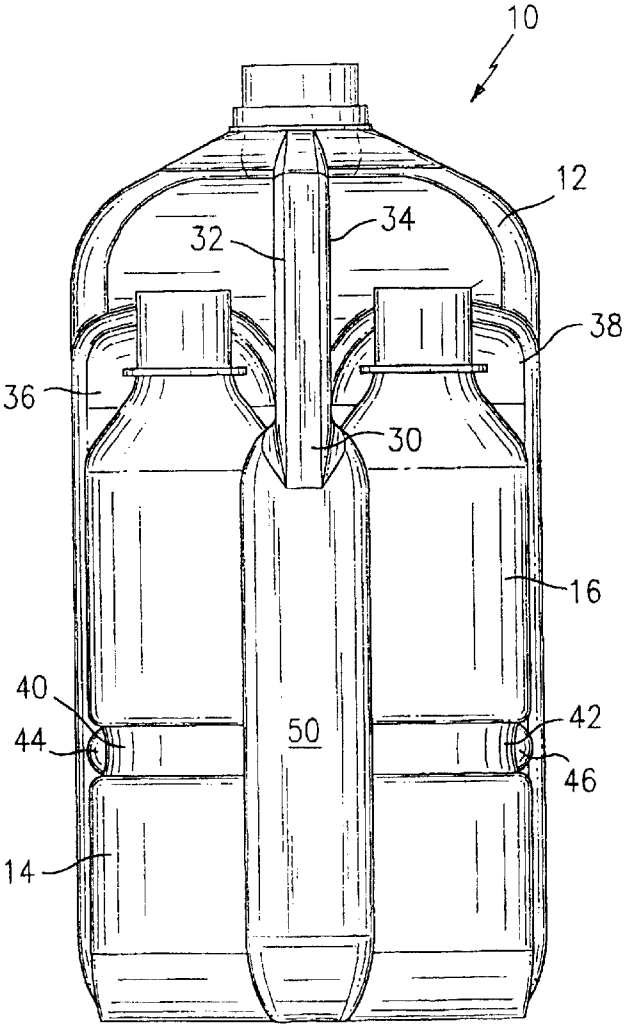
FIG. 2 is a front view of the assembly of FIG. 1.
Figure 1:
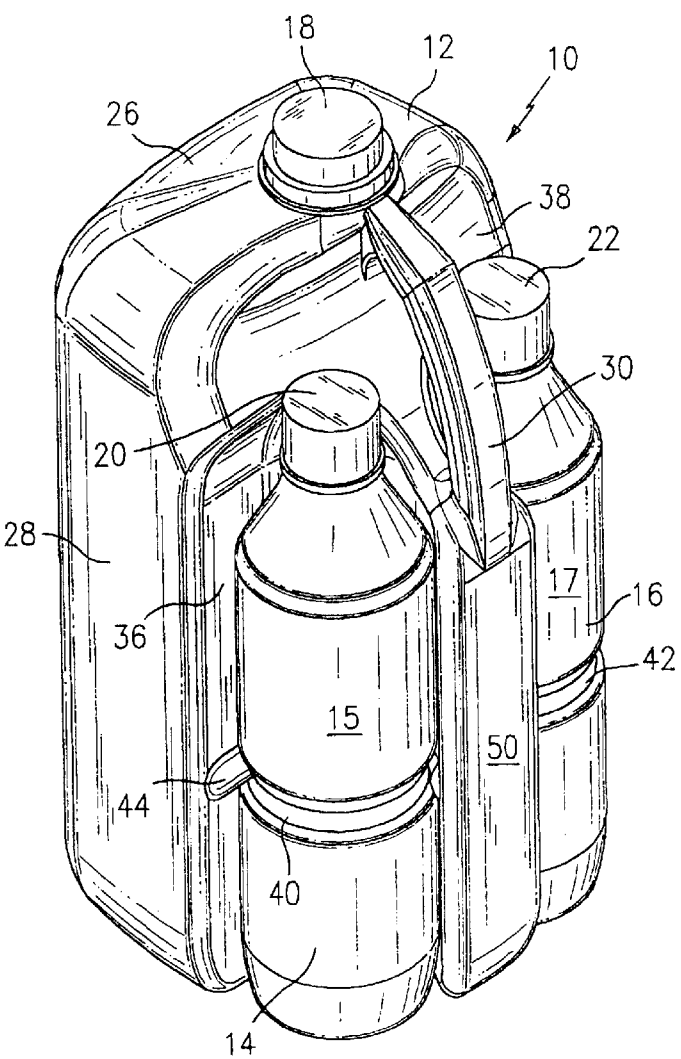
FIG. 1 is a perspective view of a container package assembly of the present invention.
Figure 4:
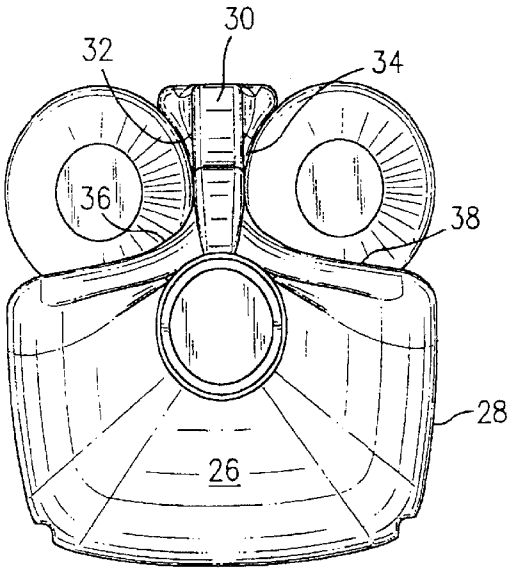
FIG. 4 is a top view of the assembly of FIG. 1.

Referring to the drawings, a nested container package assembly 10 is shown in FIGS. 1 and 2, including larger first container 12 and two smaller second containers 14 and 16. The containers are preferably made of a pliable, deformable synthetic polymeric material, such as polyethylene or polyethylene terephthalate or other plastic.

The first and second containers are designed for holding contents, as fluids, such as for example water or juice, or powders or the like and are each provided with respective closures 18, 20 and 22 for dispensing contents. Larger container 12 is particularly useful for refilling the smaller containers 14, 16 which desirably have easily refillable caps. If desired, the smaller containers can be provided with a dispensing spout, as a push-pull spout, and can be designed as squeeze bottles. Alternatively, the first and second containers are also useful as a combination package where refilling is not necessarily contemplated.

Figure 5:
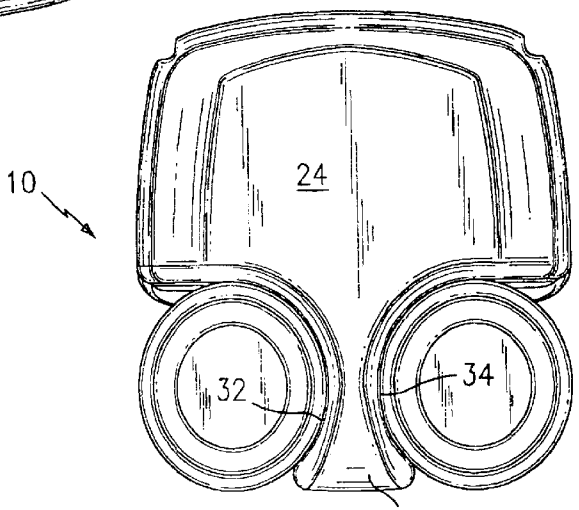
FIG. 5 is a bottom view of the assembly of FIG. 1.
Figure 3:
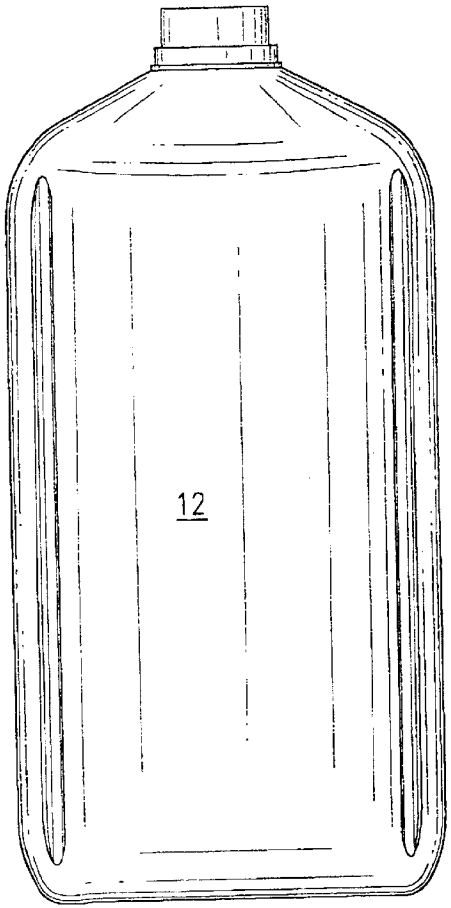
FIG. 3 is a back view of the assembly of FIG. 1.

First container 12 includes a bottom wall 24 (FIG. 5), top wall 26 and side wall 28. The side wall may include angular segments as shown in these embodiments or may be substantially circular. The side wall 28 provides a circumferential wall defining the side periphery of the container.

A handle 30 is formed integral with first container 12 and extends outwardly from the side wall 28 thereof on one side of the first container. Handle 30 is provided with first side portion 32 and opposed second side portion 34. A first recess 36 is formed by handle 30, first side portion 32 and side wall 28 adjacent to side portion 32, and a second recess 38 is formed by handle 30, second side portion 34 and side wall 28 adjacent to side portion 34.

At least one second container 14 and preferably two second containers 14, 16, are dimensioned to be inserted in and are tightly secured in respective recesses 36, 28 as will be described below.

Figure 6:
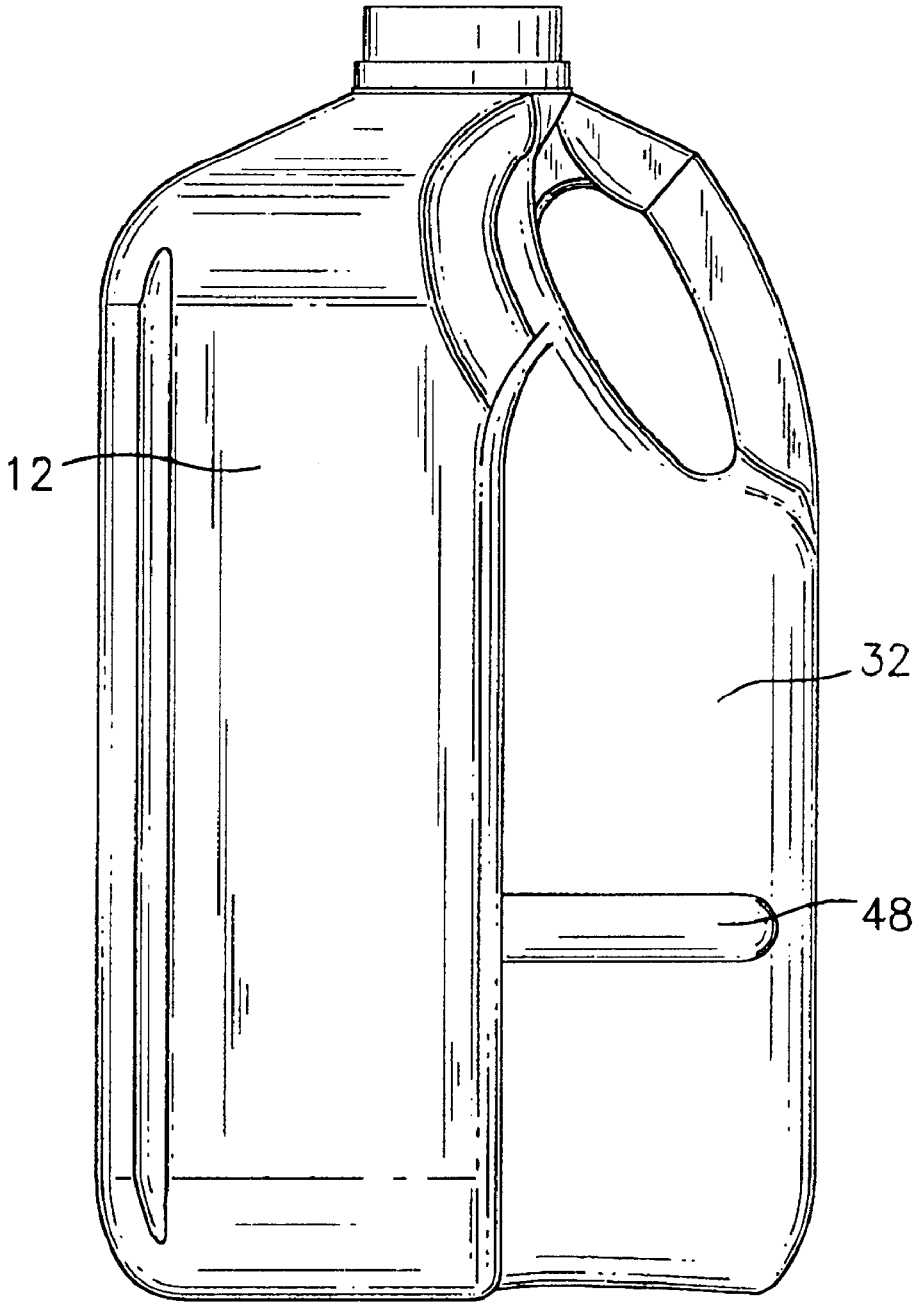
FIG. 6 is a side view of the first, larger container, without the second containers nested therein.

The second containers 14, 16 are each provided with side walls 15 and 17, respectively and a circumferential groove 40, 42 in side walls 15 and 17, respectively, which may or may not completely circumscribe the second containers. The side wall portions 28 of first container 12 in recesses 36 and 38 are provided with outwardly extending projections 44, 46. The second containers 14, 16 are tightly secured in respective recesses 36 and 38 by inserting projections 44, 46 in grooves 40, 42. If desired, the projections can be provided on the second containers and the grooves on the first container. Also, the projections or grooves on the first container desirably extend either continuously or discontinuously onto handle 30, first side portion 32 and opposed second side portion 34 as shown in FIG. 6 for projection 48 of handle first side portion 32 for firmer engagement with the second containers. The pliable nature of the plastic containers will readily permit snap-in engagement between the projections and grooves.

In order to provide a more secure engagement between the first and second containers, handle 30 of first container 12 is desirably provided with an outwardly extending peripheral portion 50 which partly overlaps second containers 14 and 16.

Figure 7:
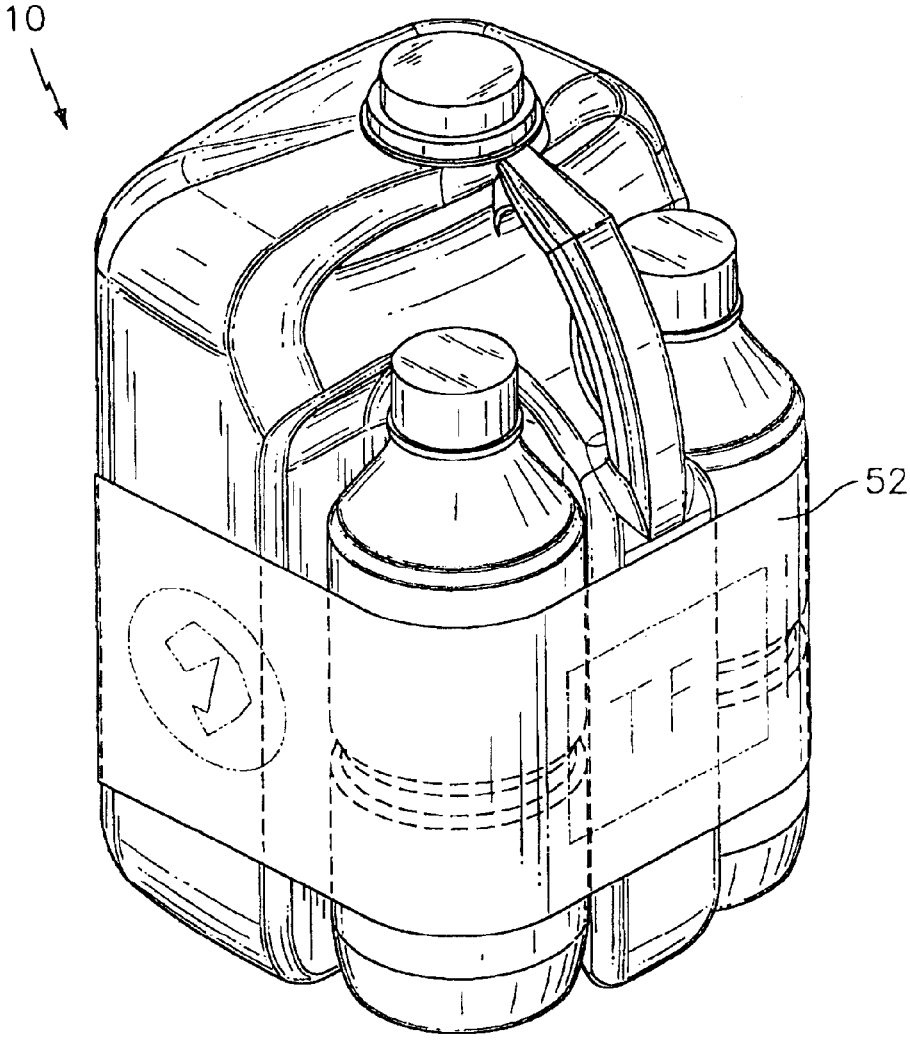
FIG. 7 is a perspective view similar to FIG. 1 with a circumferential wrapping surrounding the assembly.

If desired, a circumferential wrapping 52 can be provided surrounding the container assembly 10 as shown in FIG. 7, which may include advertising material and other indicia and assist in shipping and handling. Naturally, the wrapping should be such as to enable convenient removal prior to use. The wrapping may conveniently be a shrink- fit wrapping, if desired.

The particular sizes and shapes of the respective containers may be varied depending on particular needs and applications. It is particularly advantageous to provide a first container of a larger size to enable refilling of smaller second containers by the first container.

The present invention provides a convenient unitary package with large and small containers for easy and convenient refilling of the small containers if refilling is contemplated. The assembly is suitable for a circumferential wrapping which may be a shrink-fit wrapping. The assembly desirably may have a footprint of a single large container which lends itself to convenient positioning on store shelves while occupying the same amount of shelf space as a single large container. This represents a significant advantage of the present invention. In addition, the total contents of the assembly may advantageously be the same as a single larger container. Thus, for example, the total contents of all containers in the assembly can advantageously be essentially one (1) gallon which would be the same as a single gallon size container. Moreover, the simple interlocking relationship of the containers is attractive and easy to use.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A nested container assembly, which comprises:

a first container for holding contents, said first container having a bottom wall, top wall and side wall, and a handle integrally formed thereon and extending outwardly from the side wall of the first container;

at least one recess formed by the handle and adjacent side wall of the first container;

at least one second container for holding contents dimensioned to be inserted in said recess, said second container having a side wall;

a groove in one of the side wall of the second container and said recess, and a projection extending outwardly from the other of the side wall of the second container and said recess;

wherein said outwardly extending handle includes a downwardly extending portion which extends along the side wall of said first container towards the bottom wall of said first container and which includes a peripheral portion extending outwardly along the handle which partly overlaps the second container;

whereby, said first and second containers are secured tightly together by inserting said second container in said recess and said projection in said groove.

2. An assembly according to claim 1, wherein the groove is on the side wall of the second container.

3. An assembly according to claim 2, wherein the groove is a circumferential groove circumscribing the side wall of the second container.

4. An assembly according to claim 1, wherein the first container is substantially larger than the second container.

5. An assembly according to claim 1, wherein said handle includes a side portion thereof in part forming said recess, wherein said handle side portion includes one of a groove and projection which engages the other of said groove and projection of the second container.

6. An assembly according to claim 1, including two of said recesses formed on opposed sides of said handle and two of said second containers with one of said second containers inserted in each recess.

7. An assembly according to claim 1, wherein said outwardly extending handle extends to the bottom wall of the first container.

8. An assembly according to claim 6, wherein the outwardly extending handle of the first container includes a peripheral portion which partly overlap both of said second containers.

9. An assembly according to claim 6, including a circumferential wrapping surrounding the assembly.

10. An assembly according to claim 1, wherein said containers are resilient plastic.

11. An assembly according to claim 1, wherein the total contents of the first and second container are equal to one (1) gallon.

12. An assembly according to claim 6, wherein the total contents of the first and second containers are equal to one (1) gallon.

13. An assembly according to claim 6, wherein said first and second containers are for holding a fluid or powder and wherein said first container is adapted to refill said second containers.

* * * * *